US006045880A

United States Patent [19]

Minichiello

[11] Patent Number: 6,045,880

[45] Date of Patent: Apr. 4, 2000

[54] THREE-DIMENSIONAL PLASTIC REPRESENTATION FOR ARTICLES E.G. BINDERS

[75] Inventor: Nick Minichiello, Laval, Canada

[73] Assignee: Créations Executive - 153291 Canada Inc., St-Laurent, Canada

[21] Appl. No.: 08/889,810

[22] Filed: Jul. 8, 1997

Related U.S. Application Data

[63] Continuation of application No. 08/394,493, Feb. 27, 1995, abandoned.

[30] Foreign Application Priority Data

Jan. 24, 1994 [CA] Canada ..... 2134170

[51] Int. Cl.[7] ..... A47G 1/12

[52] U.S. Cl. ..... 428/14; 428/15; 428/19; 428/38; 428/79; 428/95; 428/161; 428/187; 428/203; 428/206; 428/296; 281/18; 281/29; 281/30; 206/45.13; 206/45.18; 156/64; 156/234; 156/235

[58] Field of Search ..... 428/19, 296, 95, 428/187, 79, 15, 38, 206, 203, 161, 14; 156/235, 234, 64, 292; 206/45.18, 45.13; 281/30, 31, 18, 29

[56] References Cited

U.S. PATENT DOCUMENTS

| | | | |
|---|---|---|---|
| D. 184,004 | 12/1958 | Chase | D6/2 |
| D. 212,148 | 8/1968 | Dean | D97/1 |
| D. 323,528 | 1/1992 | Anderson | D19/27 |
| 2,051,907 | 8/1936 | Schade | 129/1 |
| 4,765,462 | 8/1988 | Rose, Jr. | 206/45.13 |
| 5,015,011 | 5/1991 | York | 281/18 |
| 5,020,828 | 6/1991 | Moor | 281/29 |
| 5,029,899 | 7/1991 | Schieppati et al. | 281/30 |
| 5,345,705 | 9/1994 | Lawrence | 40/616 |

*Primary Examiner*—Deborah Jones
*Assistant Examiner*—Abraham Bahta
*Attorney, Agent, or Firm*—Swabey Ogilvy Renault

[57] ABSTRACT

A three-dimensional relief plastic sheet for use on articles such as binders comprises a decorative overlay sheet made of a plastics material and at least one three-dimensional relief representation integrally formed on the overlay sheet, for instance, by vacuum forming. The overlay sheet is adapted to be mounted to various articles, preferably made of plastics materials, by way of adhesives, heat-sealing, high-frequency welding, etc. The overlay is preferably made of polyvinyl chloride (PVC), polyethylene or styrene (e.g. polystyrene) and thus can be secured, for example along the periphery thereof, to the vinyl covering of loose-leaf binders and other document carrying folders respectively using high-frequency welding and glues. The three-dimensional representation and the overlay sheet typically include colored sections and possibly transparent sections. A mirror-like backing sheet is provided behind the overlay sheet when there are such transparent sections.

23 Claims, 2 Drawing Sheets

THREE-DIMENSIONAL PLASTIC REPRESENTATION FOR ARTICLES E.G. BINDERS

This Application is a Continuation of application Ser. No. 08/394,493, filed Feb. 27, 1995 entitled Three dimensional Plastic representation for Articles, E. G. Binders now abandoned.

BACKGROUND OF THE INVENTION

1. Field of the Invention

The present invention relates to three-dimensional images and, more particularly, to plastic three-dimensional relief representations applied to articles, such as binders, folders for restaurant wine lists, etc., and to a method for producing such articles.

2. Description of the Prior Art

U.S. Pat. No. 5,020,828 issued on Jun. 4, 1991 to Moor discloses a binder 10 provided with a cover 12 featuring a three-dimensional design produced by depressing plastic inner and outer overlay sheets 22 and 24 into openings 35 defined through a paperboard cover panel 20 of the cover 12. The overlay sheets 22 and 24 are heat sealed together at their peripheral edges and also in the openings 35 thereby defining thereat depressions 40 and sloping regions 50.

U.S. Pat. No. 4,765,462 issued on Aug. 23, 1988 to Rose, Jr. teaches a notebook 10 for storing computer disks 12 and documentation related thereto, which comprises an articulated four-piece cover 16 including in order a top cover 30, a connection spine 31, a back cover 32 and an overlay cover 33, all hingedly connected at 35, 36 and 37. A storage compartment 18 made of two mated sections 23 and 24 which are integral to the cover 16 is provided on the facing surfaces 46 and 47 of one and the other one of the back and overlay covers 32 and 33 so as to receive therein the computer diskettes 12 when the overlay cover 33 is folded over the back cover 32.

U.S. Design Pat. No. 212,148 issued on Aug. 27, 1968 to Dean shows a loose-leaf notebook cover including a front cover which seemingly defines a series of two-dimensional pockets.

U.S. Design Pat. No. 191,030 issued on Aug. 8, 1961 to Cole et al. discloses a notebook cover defining a shallow engraving-like pattern on the front surface thereof.

U.S. Design Pat. No. 312,278 issued on Nov. 20, 1990 to Moor includes a cover forming a loop with an narrow overlay panel of staggered outline at its free end being attachable to an inner free edge of a main front cover panel so as to form the closed loop. Shallow grooves are defined on outer surfaces of the cover.

U.S. Design Pat. No. 323,528 issued on Jan. 28, 1992 to Anderson teaches a loose-leaf binder cover which includes a plurality of pockets.

U.S. Pat. No. 5,015,011 issued on May 14, 1991 to York discloses a binder 10 comprising observation windows 30 and 32 each having a bubble-like structure and each being provided within an opening 46 defined in the support board 48 of the binder 10 by depressing transparent cover sheets 50 and 52 provided on each side of the board 48 into the opening 46 and heat-sealing these sheets 50 and 52 together along a narrow track 54 located close to the peripheral edge of the opening 46. An air pocket 56 is thus defined within the track 54.

U.S. Pat. No. 5,029,899 issued on Jul. 9, 1991 to Schieppati discloses a removable protective book cover including a jacket which is removably mountable to the binding of a book and having transparent overlay sheets attached thereto. The overlay sheets can be positioned over the pages of the book without impeding the viewing of the material printed on the pages of the book.

U.S. Pat. No. 2,051,907 issued on Aug. 25, 1936 to Schade discloses a back panel for loose-leaf books which includes a decorative strip 6.

U.S. Design Pat. No. 184,004 issued on Dec. 2, 1958 to Woodmere teaches a loose-leaf clasp binder having seemingly printed material on the front cover and connection member thereof.

Also, in the field of packaging, it is well known to use a clear plastic bubble in combination with a plane paperboard backing in a what is commonly referred to as a blister pack, wherein the plastic bubble includes a peripheral flange adapted to be glued to the paperboard backing with the product being enclosed therebetween in a sealed packaging which allows for visual inspection or perusal of the product.

SUMMARY OF THE INVENTION

It is therefore an aim of the present invention to provide a three-dimensional relief representation adapted to be applied to articles.

It is also an aim of the present invention to provide a plastic sheet which defines a three-dimensional representation having printing thereon and which is adapted to be applied to articles, such as binders, folders for restaurant wine lists, etc.

It is a further aim of the present invention to provide a plastic sheet which is vacuum-formed so as to produce thereon a relief three-dimensional shape preferably having printing thereon and which is adapted to be applied to articles.

It is still a further aim of the present invention to provide a method for applying relief three-dimensional plastic representations to various articles.

Therefore, in accordance with the present invention, there is provided a three-dimensional relief sheet for use on articles such as binders, comprising a sheet means and at least one three-dimensional representation defined on said sheet means, said three-dimensional representation being integrally formed in said sheet means, said sheet means being adapted to be mounted to various articles using appropriate attachment means.

Also in accordance with the present invention, there is provided an article of the type having a cover means made of a plastics material, comprising sheet means and at least one three-dimensional relief representation defined on said sheet means, said three-dimensional relief representation being integrally formed in said sheet means, said sheet means being made of a plastics material and being secured to said cover means of said article with said three-dimensional relief representation extending away from said article thereby providing relief thereto.

Further in accordance with the present invention, there is provided a method method of producing an article with a three-dimensional relief representation thereon, comprising the steps of:

a) providing sheet means;

b) defining on said sheet means at least one three-dimensional relief representation;

c) providing a cover means made of a plastics material;

d) securing said sheet means to said cover means with said three-dimensional relief representation extending away from said article thereby providing relief thereto.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
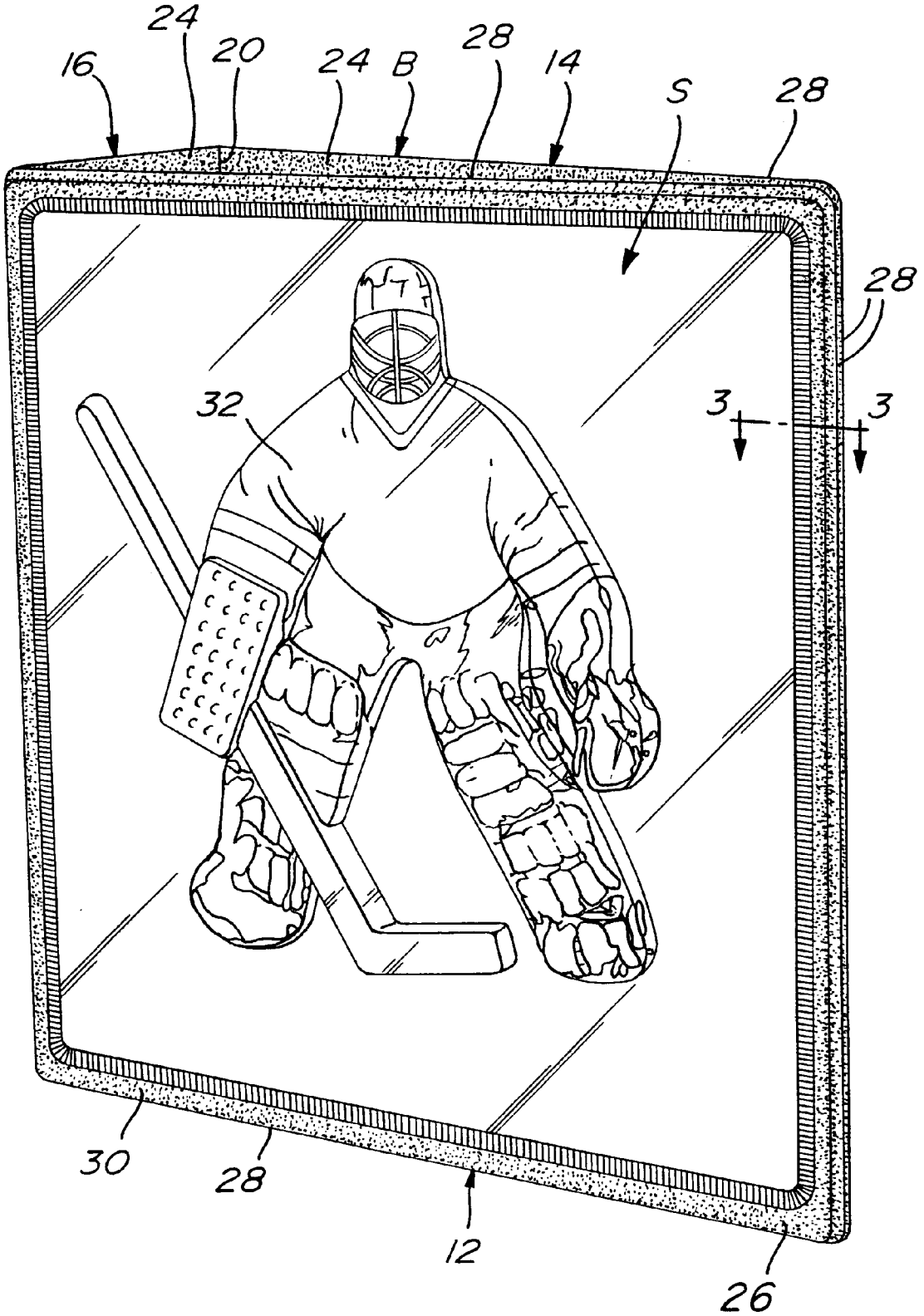
FIG. 1 is a perspective view of a plastic three-dimensional relief representation in accordance with the present invention, herein of a hockey goaltender, applied to a binder using a method also in accordance with the present invention.
Figure 2:
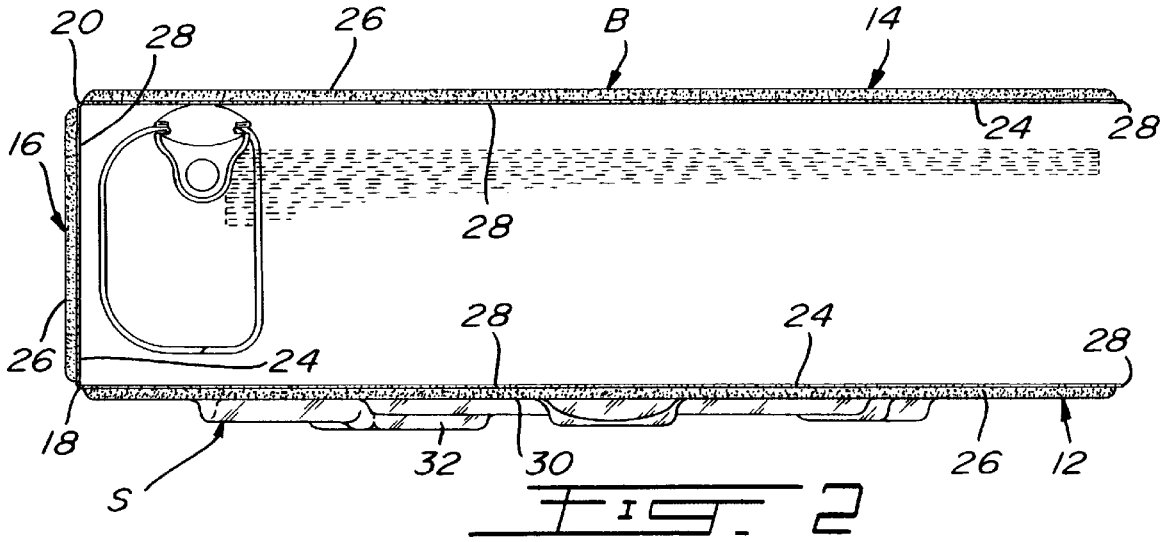
FIG. 2 is a top plan view of the binder of FIG. 1 when considered in an upstanding position thereof.
Figure 3:
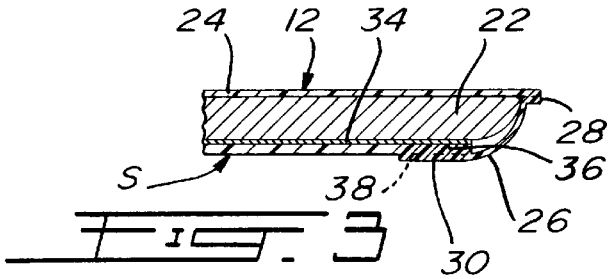
FIG. 3 is a cross-sectional detailed view taken along line 3—3 of FIG. 1 showing a connection of the plastic relief representation of the present invention to the binder.

FIGS. 1 to 3 illustrate a loose-leaf binder B comprising a three-section articulated cover which includes a front cover 12, a rear cover 14 and an intermediate cover or spine 16 provided therebetween and hingedly connected to the front and rear covers 12 and 14 respectively at hinges 18 and 20. The front and rear covers 12 and 14 and the spine 16 each comprise a substantially rigid, although somewhat flexible, inner panels 22 made, for instance, of paperboard material and further comprise inner and outer overlay sheets 24 and 26, respectively, which overlay the inner panels 22 on the inner and outer surfaces thereof. The inner and outer overlay sheets 24 and 26 which are coextensive with the inner panels 22 are made of plastics material, such as vinyl plastic, polypropylene, etc., and are joined together along peripheral edges 28 thereof generally by conventional heat-sealing or fusing methods.

In accordance with the present invention, the front cover 12 is provided on an outer surface thereof with a decorative overlay sheet S which, in the illustrated embodiment, replaces in large part the outer overlay sheet 26 of the front cover 12, whereby the outer overlay sheet 26 on the outer side of the front cover 12 herein takes the form of a peripheral strip 30 which is connected by heat-sealing at its outer periphery to the peripheral edge 28 of the inner overlay sheet 24 of the front cover 12.

The decorative overlay sheet S is preferably made of a plastics material which has been vacuum-formed at predetermined specific portions thereof, and in various degrees, to produce a three-dimensional relief representation 32 thereon. Any portions of the decorative overlay sheet S including especially the representation 32 can have printing thereon, with coloring, so as to improve the appeal or attractiveness of the representation 32 and/or to better define the various sections thereof.

In the embodiment illustrated in FIGS. 1 to 3, the representation includes portions which are clear or at least translucent (as opposed to other portions thereof which possibly may include some substantially opaque printing thereon). In such cases, there is provided a backing sheet 34 (see FIG. 3) behind the decorative overlay sheet S, that is between the latter and the paperboard inner panel 22 of the front cover 12. The backing sheet 34 which is of dimensions substantially equal to the decorative overlay sheet S has a mirror-like finish facing outwardly of the inner panel 22 of the front cover 12 and thus facing towards the decorative overlay sheet S and its relief representation 32, whereby the three-dimensional relief effect of the representation 32 is accentuated by the mirror-like backing sheet 34.

The decorative overlay sheet S has a peripheral border 36 which is inserted under the peripheral vinyl strip 30, that is between the latter and the mirror-like backing sheet 34, and which attached to the peripheral strip 30 by appropriate adhesion means. More particularly, in the case where the decorative overlay sheet S is made of PVC (i.e. polyvinyl chloride), the peripheral border 36 of the decorative overlay sheet S is high-frequency (i.e. HF) welded to the peripheral strip 30 as PVC and vinyl constitute materials which are compatible to HF welding. The results of such HF welding are well illustrated in the FIGS. 1 and 3 at 38.

Figure 4:
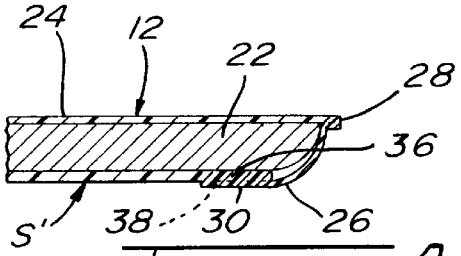
FIG. 4 is a cross-sectional detailed view similar to FIG. 3 but showing a variant of a three-dimensional relief image in accordance with the present invention.

FIG. 4 illustrates a variant S' of a decorative overlay sheet which is similar to the decorative overlay sheet S of FIGS. 1 to 3 aside from the mirror-like backing sheet 34 which is absent from the decorative overlay sheet S' of FIG. 4 as the mirror effect might not be desired in some cases of three-dimensional representations, for instance, such as when the decorative overlay sheet S' has—colored—printing thereon which renders the decorative overlay sheet S' completely opaque.

Figure 5:
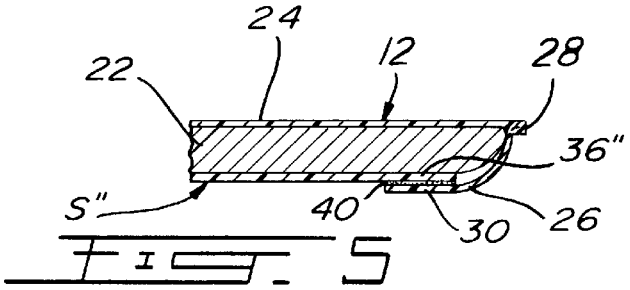
FIG. 5 is a cross-sectional detailed view similar to FIG. 3 but showing a further variant of a three-dimensional relief image in accordance with the present invention.

FIG. 5 illustrates a further variant S" of a decorative overlay sheet which is similar to the decorative overlay sheet S' of FIG. 4 aside from the fact that the decorative overlay sheet S" is made of styrene plastic as opposed to the PVC used for both the decorative overlay sheets S and S' of FIGS. 1 to 3 and 4. In the case of styrene plastic, the peripheral border 36" of the decorative overlay sheet S" cannot be welded under high frequency to the vinyl peripheral strip 30 but must be glued thereto with an appropriate glue 40.

It is noted that the decorative overlay sheets S, S' and S" of the present invention can be used on other articles than binders, such as on presentation folders used, for instance, for holding wine lists. Furthermore, the decorative overlay sheets S, S' and S" can be produced in a variety of materials (including the aforementioned styrene plastic and PVC) for connection to other elements made also from a variety of materials (including the aforementioned vinyl plastic) with appropriate adhesive means, such as HF welding, heat-sealing, adhesives, etc., being used to secure the decorative overlay sheets to these elements.

Furthermore, the relief representation can be formed in a sheet of polyethylene (Duraflex) which is then formed into a binder, whereby in such a case the plastic sheet defining the relief is not glued or bonded by HFs to the remainder of the binder, e.g. to the vinyl thereof, but is integral therewith. In other words, the cover of the binder is made of a single material, e.g. polyethylene, and the relief representation is formed thereon.

I claim:

1. A folding article for holding paper sheets, comprising cover means having at least front and back panel means hingedly connected together for receiving sheets therebetween, at least one of said front and back panel means comprising outer sheet means and at least one three-dimensional representation defined on said outer sheet means, said three-dimensional representation being integrally formed in said outer sheet means and extending outwardly of said outer sheet means.

2. A folding article for holding paper sheets as defined in claim 1, wherein said outer sheet means is made of a plastics material, and wherein said three-dimensional representation defines a closed hollow cavity in said cover means.

3. A folding article for holding paper sheets as defined in claim 2, wherein said outer sheet means is made of one of styrene and polyvinyl chloride, wherein said outer sheet means when made of styrene is adapted to be mounted to the plastic article by way of adhesive means, and wherein said outer sheet means when made of polyvinyl chloride is adapted to be mounted to the plastic article by way of high-frequency welding.

4. A folding article for holding paper sheets as defined in claim 1, wherein said outer sheet means is substantially plane and is mounted to said cover means along peripheral borders of said outer sheet means with said three-dimensional representation extending outwardly from a plane of said outer sheet means.

5. A folding article for hold paper sheets as defined in claim 1, wherein at least said three-dimensional representation comprises at least one substantially transparent section.

6. A folding article for holding paper sheets as defined in claim 5, wherein said cover means also comprises a reflective backing sheet adapted to be positioned behind said outer sheet means opposite a relief-carrying side thereof, said backing sheet being positioned at least partly opposite said transparent section of said three-dimensional representation.

7. A folding article for holding paper sheets as defined in claim 1, wherein at least said three-dimensional representation is at least partly colored.

8. A binder for receiving paper sheets therein, comprising cover means and holding means for holding paper sheets within said cover means, said cover means comprising at least one three-dimensional relief representation, said three-dimensional representation being integrally formed in said cover means and being made of a plastics material, said three-dimensional relief representation extending away from a main outer plane of said cover means thereby providing relief thereto.

9. A binder as defined in claim 8, wherein said cover means comprise a cover, panel means made of a plastics material and sheet means defining said three-dimensional representation and being secured to said panel means, said panel means being provided on said cover and defining an opening means smaller than said sheet means, peripheral borders of said sheet means being disposed between said cover and inner sections of said panel means outwardly delimiting said ope ning means with a remainder of said sheet means extending within said peripheral borders being visible through said opening means and with said three-dimensional relief representation extending through said opening means and outwardly of said cover, said peripheral borders and said inner sections being secured together with mounting means.

10. A binder as defined in claim 9, wherein said sheet means is made of one of styrene and polyvinyl chloride, said panel means being made of a vinyl plastic, wherein said sheet means when made of styrene is mounted to said panel means by way of an adhesive, and wherein said sheet means when made of polyvinyl chloride is mounted to said panel means by way of high-frequency welding.

11. A binder as defined in claim 8, wherein at least said three-dimensional representation comprises at least one substantially transparent section.

12. A binder as defined in claim 11, wherein said cover means also comprises a reflective backing sheet positioned inwardly of and at least partly opposite said transparent section of said three-dimensional representation.

13. A binder as defined in claim 8, wherein at least said three-dimensional representation is at least partly colored.

14. A binder as defined in claim 9, wherein said sheet means is integral with said panel means.

15. A binder as defined in claim 14, wherein said sheet means and said panel means are made of polyethylene.

16. A binder as defined in claim 8, wherein said three-dimensional representation defines a closed cavity in said cover means.

17. A method of producing a folding article for receiving paper sheets therebetween with a three-dimensional relief representation on said article, comprising the steps of:

a) providing sheet means made of a plastics material and at least one three-dimensional relief representation;

b) providing a panel means for receiving paper sheets therewithin;

c) securing said sheet means to said panel means with said three-dimensional relief representation extending away from said folding article thereby providing relief thereto.

18. A method as defined in claim 17, wherein, in step a), said sheet means is first provided with said three-dimensional representation being then made on said sheet means by vacuum forming, and wherein in step (c), said sheet means defines a closed hollow cavity inwardly of said three-dimensional representation.

19. A method as defined in claim 17, wherein, in step b), a cover is provided and an opening means is defined in said panel means, said opening means being smaller than said sheet means; and wherein, in step c), said panel means is installed on said cover peripheral borders of said sheet means being disposed between said cover and inner sections of said panel means outwardly delimiting said opening means, with a remainder of said sheet means extending within said peripheral borders being visible through said opening means and with said three-dimensional relief representation extending through said opening means and outwardly of said cover, said peripheral borders and said inner sections being secured together.

20. A method as defined in claim 19, wherein said sheet means is made of one of styrene and polyvinyl chloride, said panel means being made of a vinyl plastic; and wherein in step c) said sheet means when made of styrene is mounted to said panel means by way of an adhesive or when made of polyvinyl chloride is mounted to said panel means by way of high-frequency welding.

21. A method as defined in claim 19, wherein at least said three-dimensional representation comprises at least one substantially transparent section.

22. A method as defined in claim 21, wherein said article also comprises a reflective backing sheet positioned in step c) between said sheet means and said cover, and at least partly opposite said transparent section of said three-dimensional representation.

23. A method as defined in claim 17, wherein at least said three-dimensional representation is at least partly colored.

* * * * *